US005111184A

United States Patent [19]

Heaton et al.

[11] Patent Number: 5,111,184

[45] Date of Patent: May 5, 1992

[54] TAMPER-PROOF DEVICE FOR DETECTING OPENING AND CLOSING OF A SECURE CONTAINER

[75] Inventors: Harley L. Heaton, Manassas, Va.; Michael R. Arneson, Westminster, Md.; Guy P. LaRocca, Centreville, Va.

[73] Assignee: Atlantic Research Corporation, Alexandria, Va.

[21] Appl. No.: 659,619

[22] Filed: Feb. 25, 1991

[51] Int. Cl.[5] ..... G08B 13/12

[52] U.S. Cl. ..... 340/542; 340/550; 340/556

[58] Field of Search ..... 250/227.14, 227.16, 250/231.10, 231.19; 340/540, 542, 550, 552, 553, 555, 545, 556, 557

[56] References Cited

U.S. PATENT DOCUMENTS 3,854,792 12/1974 Koelle .
4,292,628 9/1981 Sadler ..... 340/555
4,358,678 11/1982 Lawrence ..... 250/231.19
4,729,626 3/1988 Stieff ..... 340/541
4,729,630 3/1988 Martinez ..... 250/227.16

*Primary Examiner*—Jin F. Ng
*Assistant Examiner*—Christine K. Oda
*Attorney, Agent, or Firm*—Laubscher, Presta & Laubscher

[57] ABSTRACT

A tamper-proof device for detecting opening and closing events of a secure container is characterized by a fiber optic cable having a first portion connected with a fixed member of the container and a second portion connected with a movable locking member of the container so that the cable is bent or flexed when the container locking member is moved between open and closed positions. Light pulses are transmitted through the cable and variations in the pulses resulting from bending of the cable are detected to indicate opening and closing of the container.

12 Claims, 1 Drawing Sheet

TAMPER-PROOF DEVICE FOR DETECTING OPENING AND CLOSING OF A SECURE CONTAINER

The Government has rights in this invention pursuant to Contract No. MDA-904-89C-2206 awarded by the Maryland Procurement Office.

BACKGROUND OF THE INVENTION

Monitoring the opening and closing of a secure container such as a safe is useful in determining whether the security of the container has been violated or compromised. The present invention relates to an assembly which detects openings and closings of a safe and provides a record of such events for comparison with authorized openings and closings. The assembly includes a fiber optic loop connected with the container. Openings and closings of the container bend the loop, attenuating a light signal transmitted therethrough. The attenuations are detected and used to monitor opening and closing events.

BRIEF DESCRIPTION OF THE PRIOR ART

Fiber optic security seals are well-known in the patented prior art as evidenced by the patents to Koelle U.S. Pat. No. 3,854,702 and Stieff U.S. Pat. No. 4,729,626. The Koelle patent, for example, discloses a fiber optic security seal wherein the fibers at one end of a fiber optic bundle preferably comprise randomly distributed fibers that are secured relatively stationary with respect to each other. The bundle is passed through a receiver for sealing a container or the like. One end of the bundle is masked and illuminated to produce a particular output light pattern at the other end of the bundle. The output light pattern is recorded. The fiber optic seal may be inspected by illuminating the masked end and comparing the light pattern at the other end with the recorded pattern.

The Stieff patent discloses a seal having a fiber optic bundle which passes through a fastening device. One end of the bundle is exposed to a light source and the light pattern emitted from the other end is observed to determine whether anyone has tampered with the fiber optic bundle or the fastening device.

While the prior devices normally operate satisfactorily, they are single use devices. That is, when the seal is broken, fiber optics are no longer usable. Thus, the prior devices are not satisfactory for monitoring openings and closings of secure containers.

The present invention was developed in order to overcome these and other drawbacks of the prior devices by providing a fiber optic displacement sensor which provides detection and indication of opening and closing events of a secure container such as a safe.

SUMMARY OF THE INVENTION

Accordingly, it is a primary object of the present invention to provide a tamper-proof device for detecting opening and closing events of a secure container. The device includes a fiber optic cable having a first portion connected with a fixed member of the container and a second portion connected with a movable closure of the container. The cable is thus deflected when the container closure is moved between open and closed positions. A pulsed optical source such as a light emitting diode or a laser is connected with one end of the cable for delivering a light signal thereto. An optical detector is connected with the other end of the cable for sensing variations in the light signal due to deflection of the cable, whereby each opening and closing event of the container is detected.

A microcontroller including a timer and a memory is connected with the optical detector for operation in response to an opening or closing event. The timer provides a time reference for each opening and closing, and the memory stores the occurrence and time of each event.

A display, such as a liquid crystal diode, is connected with the microcontroller to indicate the occurrence and timing of events.

In addition to the display, information from the microcontroller concerning the time and occurrence of events may be obtained by a portable computer via a secure optical communication network. A fiber optic modem is connected with the microcontroller and converts data therein to optical signals which are transmitted via a fiber optic cable assembly. A second modem is connected with the other end of the cable assembly and converts the optical signals back to electrical data signals. A portable computer is removably connected with the second modem to access the data upon entry of a password.

BRIEF DESCRIPTION OF THE DRAWING

Other objects and advantages of the invention will become apparent from a study of the following specification when viewed in the light of the accompanying drawing, in which.

DETAILED DESCRIPTION

Figures 1, 2A, 2B:
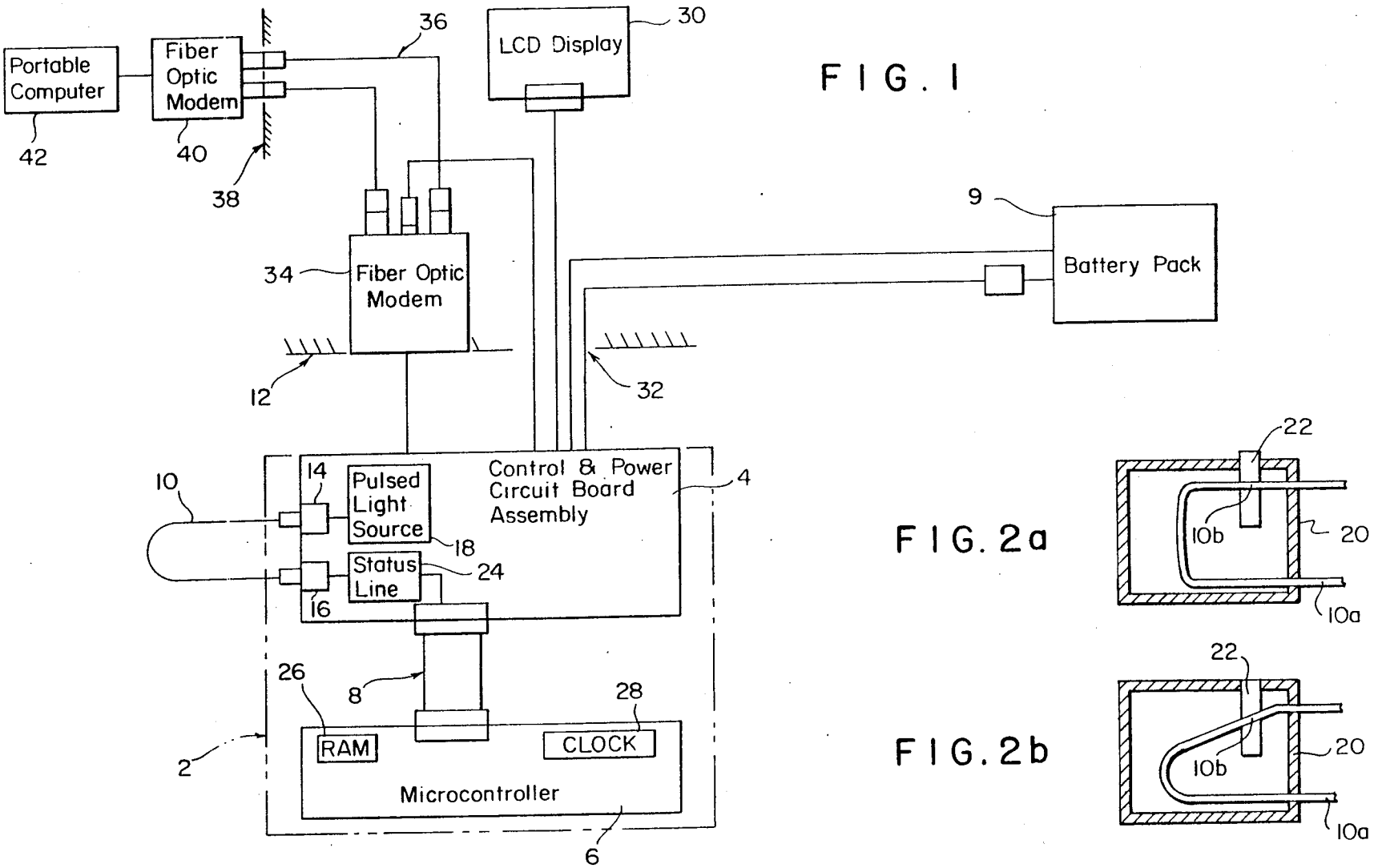
FIG. 1 is a block diagram of the secure container opening detection device according to the invention.
FIG. 2*a* and 2*b* are sectional views of the door of the secure container with its lock bar in closed and opened positions, respectively, with a fiber optic cable connected therewith.

The secure container opening detection device according to the invention will first be described with reference to FIG. 1. The device includes a control box 2 in which is provided a control and power printed circuit board assembly 4 and a microcontroller board 6 connected with the assembly 4 via a cable 8. A battery pack 9 is connected with the control and power circuit board assembly to provide the electrical power necessary for operation of the detection device.

Protruding from the control box 2 is a fiber optic cable loop 10 which, as will be discussed in greater detail below, is connected with a secure container such as a safe 12. A fiber optic transmitter 14 is connected with one end of the loop 10 and a fiber optic receiver or detector 16 is connected with the other end of the loop. A pulsed light source 18 is connected with the transmitter for delivering a pulsed light or optical signal to the cable loop. The light source could be a laser, a light emitting diode (LED), or any other source capable of producing a pulsed light signal. Preferably, the pulsed light signal comprises two optical frequencies which are beat together. Such a signal is easy to detect at the receiver 16.

Referring now to FIG. 2, the connection of the cable loop 10 to the safe will be described. The cable loop includes a first portion 10*a* which is connected with a fixed portion of the safe such as the safe center column 20. The cable loop also includes a second portion 10*b* which is connected with a movable portion of the safe such as the locking bar 22 of the safe door. In FIG. *2a*, the safe is shown in the closed position with the locking bar 22 extending into an opening in the safe wall (not shown). In order to open the safe, the handle (also not shown) is rotated to retract the locking bar into the position shown in FIG. *2b*.

Retraction of the locking bar to the open position of FIG. *2b* bends the fiber optic cable loop from its normal position shown in FIG. *2a*. Flexing or bending of the cable causes attenuation of the pulsed light signal travelling therethrough. When the level of light reaching the detector 16 is sufficiently decreased, a status line 24 on the control and power circuit board assembly changes state to energize the microcontroller 6.

The microcontroller includes a non-volative random access memory 26 and a clock 28. The clock provides a time reference for the occurrence of opening and closing events of the safe as sensed by the detector 16. The memory stores the occurrence of events sequentially by time and date for later retrieval.

When the safe handle is returned to its closed state, the locking bar extends to the position of FIG. *2a* and the fiber optic cable loop returns to its normal condition. Thus, light pulses from the transmitter 14 are again present at the detector which causes the status line on the control and power printed circuit board to change state, thereby energizing the microcontroller for logging the new activity.

A direct readout of the date and time of an opening event is provided on a liquid crystal diode (LCD) display 30 which is connected with the control box via a cable assembly 32. The display 30 can indicate the date and time of the present opening, as well as the dates and times of the previous opening and closing, to verify openings and closings with a written record of authorized openings and closings.

The detection system also includes interface circuitry affording communication with the microcontroller. Specifically, a fiber optic modem 34 is connected with the microcontroller 6 via the cable assembly 8 and the control and power circuit board assembly. The modem converts internal RS-232 data to optical data signals which are transmitted via a fiber optic bundle 36 to a remote location 38 where a further fiber optic modem 40 converts the optical signals back to RS-232 data. A portable computer 42 is removably connected with the modem 40 to transfer information to and from the microcontroller.

A communication link between the portable computer 42 and the microcontroller 6 is only established upon entry of a password. Once the link is established, the user can access the microcontroller to transfer data relating to opening and closing events from the RAM 26, to reset the clock 28, or to change the password. If an incorrect password is entered, communication with the microcontroller is prevented. If more than a given number of password errors are made, the apparatus will send the message LOCKOUT ACTIVE, NO ACCESS to the portable computer. The apparatus will continue to log all safe activity, but will ignore all input attempted via the fiber-optic port. The lockout will remain in effect for any given period of time, following which it will be automatically lifted.

While the opening detection system of the invention has been described with reference to a safe, it can easily be adapted for use with any secure container or room where openings to the secured area are to be monitored and logged.

The microcontroller is the heart of the apparatus and can be set to operate under an infinite number of conditions. A suitable microcontroller is the BCC52C manufactured by Micromint, Inc. Once energized in response to a low light signal from the detector 16 in response to an opening event, the microcontroller—and thus the electronics of the system—will stay energized for a predetermined period of time during which access to the container is afforded. Also during this time, the portable computer can communicate with the microcontroller following entry of the appropriate password.

The detection device is tamper-proof since it can be arranged completely within the container being secured. Thus, the fiber optic cable loop 10 can not be disconnected or cut without opening the container. An unauthorized opening of the container will thus be detected by the detector and its occurrence stored in the memory. Subsequent comparison with a written log of authorized openings will show when security was violated. Only the external fiber optics 36 are arranged outside of the enclosure. They afford only a communication function and not a detection function. The use of optical signals for communication enhances the security of the device, as does the use of a dual frequency light signal within the fiber optic cable loop 10.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A tamper-proof device for detecting opening and closing events of a secure container, comprising (a) a fiber optic cable having a first portion connected with a fixed member of the container and a second portion connected with a movable locking member of the container, whereby said cable is deflected when the container locking member is moved between open and closed positions;

(b) an optical source connected with one end of said cable for delivering a light signal to said cable; and (c) optical detector means connected with the other end of said cable for sensing variations in the light signal transmitted through the cable as a result of microbend losses due to deflection of said cable, whereby each opening and closing event of the container is detected.

2. A device as defined in claim 1, wherein said optical source includes means for producing a pulsed light signal, thereby to conserve power.

3. A device as defined in claim 2, wherein said pulsed light signal comprises two optical frequencies which are beat together.

4. A device as defined in claim 1, and further comprising microcontroller means connected with said detector means, said microcontroller means being operable in response to an event.

5. A device as defined in claim 4, wherein said microcontroller means includes timing means for timing each opening and closing event.

6. A device as defined in claim 5, wherein said microcontroller means further includes memory means for storing the occurrence of events and the times thereof.

7. A device as defined in claim 6, and further comprising display means connected with said microcontroller mean for indicating events.

8. A device as defined in claim 7, wherein said display means comprises a liquid crystal diode.

9. A device as defined in claim 7, and further comprising a fiber optic modem connected with said microcontroller for communicating therewith.

10. A device as defined in claim 9, and further comprising an interface device connected with said modem via a fiber optic cable assembly for reading data from said memory means, for providing a password for access to said microcontroller, and for resetting said timing means.

11. A device as defined in claim 2, wherein said optical source comprises light emitting diode.

12. A device as defined in claim 2, wherein said optical source comprises a laser.

* * * * *